United States Patent [19]

May

[11] 3,953,163

[45] Apr. 27, 1976

[54] IMPROVEMENTS IN OR RELATING TO ORGANIC COMPOUNDS

[75] Inventor: Max May, Bottmingen, Switzerland

[73] Assignee: Sandoz Ltd., Basel, Switzerland

[22] Filed: Mar. 3, 1975

[21] Appl. No.: 554,991

[30] Foreign Application Priority Data

Mar. 8, 1974 Switzerland ..... 3287/74

[52] U.S. Cl. ..... 8/94.26; 8/94.27; 8/94.33

[51] Int. Cl.[2] ..... C14C 3/20

[58] Field of Search ..... 8/94.27, 94.19 C, 94.26, 8/94.33

[56] References Cited

UNITED STATES PATENTS 3,423,162 1/1969 Papayannis et al. ..... 8/94.25

3,480,379 11/1969 Lipowski et al. ..... 8/94.24

3,650,666 3/1972 Shimizu et al. ..... 8/94.22

FOREIGN PATENTS OR APPLICATIONS 2,231,149 1/1973 Germany

*Primary Examiner*—John Kight, III

*Attorney, Agent, or Firm*—Gerald D. Sharkin; Richard E. Vila; Joseph J. Borovian

[57] ABSTRACT

Disclosed is a tanning agent for leather comprising a chromium or zirconium salt, preferably the sulphate, and an aryl sulphone, the tanning of leather therewith and the use of the aryl sulphone per se in chrome, vegetable or synthetic tanning of leather and in fat liquoring processes for leather.

17 Claims, No Drawings

IMPROVEMENTS IN OR RELATING TO ORGANIC COMPOUNDS

The invention relates to arylsulphones and the use thereof in the finishing and treatment of leather.

According to one aspect of the invention there is provided a tanning agent for leather, being the product of admixture of a zirconium or chromium salt and an aryl sulphone composition, which composition is obtainable by a. sulphonation with sulphuric acid and at a temperature of from 80° to 150° C, a component (i) comprising at least one aromatic phenolic compound containing from 6 to 20 carbon atoms and having at least one hydroxyl group bound to a phenyl ring, and a component (ii) comprising at least one aromatic, non-phenolic compound containing from 6 to 20 carbon atoms, from 1 to 30% of component (i) and from 99 to 70% of component (ii), based on the total weight of components (i) and (ii), being employed, and removing water of sulphonation produced, and b. condensing the resulting sulphonation product together with any unsulphonated components (i) and (ii), at a temperature of from 120° to 220° C, until the acid number of the mixture remains substantially constant.

Suitable phenolic compounds for use as component (i) are compounds of formula I,

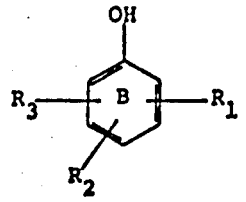

I in which either $R_1$, $R_2$ and $R_3$ are the same of different and each signifies hydrogen, hydroxyl, halogen, carboxyl or a radical of formula II, $$A - (X)_n - \qquad \text{II}$$

in which X signifies —O—, —S—, —SO—, —$SO_2$ or straight or branched chain, unsubstituted or substituted alkylene of 1 to 4 carbon atoms,

*n* signifies 0 or 1, and

A signifies unsubstituted or substituted alkyl of 1 to 4 carbon atoms, or unsubstituted or substituted phenyl or diphenyl, or $R_1$, $R_2$ and $R_3$ together with ring B may signify unsubstituted or substituted alicyclic or heterocyclic radicals, provided that the compounds contain from 6 to 20 carbon atoms.

Suitable non-phenolic compounds for use as component (ii) are compounds of formula III,

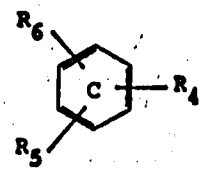

III in which $R_4$, $R_5$, $R_6$ and ring C have the same significance as $R_1$, $R_2$, $R_3$ and ring B, defined above, except that none may signify or contain hydroxy, provided that the compounds contain from 6 to 20 carbon atoms.

When X signifies, an alkylene radical, it preferably signifies the radical —$CH_2$—, $(CH_3)_2CH<$ or —$CH_2$—$CH_2$—. Suitable substituted alkylene radicals include halogen substituted alkylene radicals. When A signifies alkyl, it preferably signifies methyl, ethyl, n-propyl or isopropyl and suitable substituted alkyl radicals include haloalkyl radicals. When A signifies a substituted phenyl radical, suitable substituents include halogen, carboxyl or, radicals of formula II and, in the case of compounds I, hydroxy. Where $R_1$, $R_2$ and $R_3$ or $R_4$, $R_5$ and $R_6$ combine with ring B or C to form an alicyclic or heterocyclic radical, suitable such radicals include those of naphthalene, anthracene, fluorene and dibenzofuran.

As used herein, the term "halogen" means fluorine, chlorine, bromine or iodine, preferably chlorine.

The preferred compounds of formula I include phenols, cresols, chlorophenols, aromatic phenol carboxylic acids, phenylphenols, hydroxyphenyl ethers, hydroxydibenzofuran, hydroxydiphenylalkanes and hydroxydiphenyl sulphones. Of these, phenol, 3-methylphenol, o-chlorophenol, salicylic acid, o-phenylphenol, p-phenylphenol, 4, 4'-dihydroxydiphenyl-(2,2)-propane and 4,4'-dihydroxydiphenylsulphone are particularly preferred.

The preferred compounds of formula III include diphenyls, diphenyl ethers and sulphides and diphenylphenyl sulphides. Of these, diphenyl, diphenyl sulphide and diphenyl ether are particularly preferred. The action of the sulphones of the invention may also be modified by using as component (ii), in addition to the preferred compounds III mentioned above, for example fluorene, phenyltoluene, naphthalene, methyl naphthalene, dibenzofuran, isopropyl-diphenyl or mixtures thereof. Thus, component (ii) may, for example, comprise a mixture of 3 to 60% by weight of diphenyl, 5 to 35% by weight of phenyl-tolunes, 5 to 25% by weight of fluorene and 3 to 10% by weight of naphthalene/methyl-naphthalene.

As will be appreciated, the composition of initial starting materials may vary within wide limits. This may be e.g. diphenylether mixed with ortho-phenylphenol in a ratio of 70 to 99 : 30 to 1, preferably 80 to 97 : 20 to 3, and especially 95 : 5. The sulphuric acid is employed in a mol ratio of from 1 to 2 per mol of starting mixture, preferably 1.2 to 1.8 per mol of starting mixture and especially 1.5 per mol. Diphenylether may be replaced e.g. partially or wholy by diphenylsulphide or diphenyl or a mixture thereof.

The production of the sulphones of the compounds I and II is known and is described in detail in German Published Specification No. 2,231,149.

The preferred chromium and zirconium salts are the sulphates.

The tanning agents according to the invention possess good masking properties and are thus suitable both in pre-tanning and in principle- and re-tanning of leather. In such taning processes the tanning matter according to the invention is used in an amount so as to ve a weight ratio of zirconium or chromium salt to the eight of the pelts, or in the case of pig skin, in relation the dry weight of the skins, of from 5 to 12%, preferbly from 6 to 10%.

The ratio of sulphone to chromium or zirconium salt, the tanning agents according to the invention suitble lies between 1:100 and 1:1, preferably between 10 and 1:2.

The tannimg matter is preferably used in aqueous olution form whereby the above-mentioned mixture is the form of a 20–75%, preferably 40–60%, aqueous olution. For the acid standard, up to about 5%, preferbly 2%, of formic acid may be added thereto.

Such aqueous tanning preparations may be produced ortly before tanning takes place. They are, however, ery easy to store and may thus be made, stored and ansported as such without the chromium or zirconium salts therein being precipitated. This is surprising nce the similarly composed synthetic tanning agents ased on sulphonated phenol-formaldehyde resins are nown to result in precipitation.

During the masking process using the tanning agents ccording to the invention, letters are obtained with the arious skins (cattle, calf, pig, sheep and goat) which re especially soft, and have regular fibre structure for rain leather.

Even smoothness on the neck and centre parts is articularly advantageous for suede and buckskin when roducing pig leather, shoe leather and clothing ather, whereby a very balanced colour shade is obtined and the cutting value of the leather is decidedly nproved. The structure balancing brings about filling f the free stomach and neck parts — without hardeng on fixed centre parts — on the contrary these beome softer due to the fine fibre structure. As a result, iling agents, retanning matter, dyes and hydrophobing gents are distributed more evenly. This brings about reater, more balanced softness, regular fibre nap with uede and buckskin and regular grain strength on fullrain leathers. Dyes are absorbed evenly and show ntensive colour in spite of the chromium masking.

With the tanning agents according to the invention, a uch better filling effect, better fibre structure and alance are obtained directly, as against those obtained ith masking agents such as Na-formiate, Na-phthaate, Na-oxalate, Na-citrate etc. Also less oiling agent is quired for softening.

In neutralisation processes, undesirable chromium xide spots are avoided using the agents according to e invention, as compared with pure chromium taning, this resulting in more dependability.

Using the process according to the invention, during eutralisation, the compounds to be used in the chroium tanning process may also be used advantageously s buffering agents. For such use, the chromium/zironium arylsulphone mixture is suitable employed in n amount of from 0.1 and 2.5%, preferably 1%, in elation to the chromium tanning matter.

Apart from their use in combination with chromium r zirconium salts, as above described, the arylsulhones above defined have also been found to have a ide variety of uses in the finishing and treatment of ather generally.

Thus, the arylsulphones above defined may be used conventional tanning processes in combinationn ith synthetic, chrome or vegetable tanning matter. or such uses, the arylsulphones are suitably employed an amount of from 0.5 to 10%, preferably from 1 to 3% based on the dry or folded weight of the skins being treated. They may similarly be used, in the same amounts, when tanning with so-called resin tanning matter e.g. with urea/formaldehyde, melamine/formaldehyde and dicyanodiamide/formaldehyde resin tanning agents.

Further, the arylsulphones above defined may be employed in fat liquoring processes in the treatment of leather. For such use, the arylsulphones are suitably employed in an amount of from 0.3 to 3%, preferably from 1 to 2% based on the folded weight of the leather. In such processes, the arylsulphones facilitate distribution of the fat and thus improve the softening effect thereof.

Still further, the arylsulphones, above defined, may be used in the dyeing of leather, they having been found to have a levelling effect and serve to increase the colouring. They may suitably be employed when dyeing with basic, acid, chromium complex and direct dyes and perform the function of dispersing agents. When employed as additives in dyeing processes for leather, the arylsulphones are suitably employed in an amount fron 0.5 to 10%, preferably from 1 to 4% based on the folded weight of the skins.

The following Examples, in which all parts and percentages are by weight, illustrate the invention. The additive labelled "sulphone", used in the Examples is produced as follows:

665 parts of diphenylether and
35 parts of o-phenylphenol are mixed well together at 30° C. Over the course of 10–20 minutes and in an $N_2$— atmosphere,
606 parts of concentrated $H_2SO_4$ are added, the temperature being increased to about 65° C. With further stirring, the temperature is kept between 115° and 120° C for 6 hours. The water formed is then removed in a vacuum. The anhydrous sulphonating mixture has an acid count of 528 mval/100 g. The mixture is further stirred at 3 mm Hg and 160° C until the acid count no longer changes. The acid count of the end product should finally be 390 mval/100 g.

EXAMPLE 1

A stable, storable 60% tan liquor is obtained from
8 parts of $Cr_2(SO_4)_3$ (powder)
4 parts of the sulphone described before this Example (dry weight)
0.5 parts of formic acid (82%)
7.5 parts of water (3.5 parts of which stem from the commercial product of the above-mentioned sulphone).

Using this tan liquir, in a manner which is usual for the chromium tanning process, leather is obtained which is of excellent quality.

If instead of the 8 parts of chromium sulphate, the same amount of zirconium sulphate is used, then a white tanning matter is obtained which has excellent properties.

EXAMPLE 2

Chromium tanning of pigskin with a tanning matter standard according to the invention, which is produced in the tanning process.

A dried, limed, decalcified and drenched pig skin (weight 2.5 kilos) is treated after oiling with 20% water at 30° C, 0.75% Tergolix A, 1% of a mixture of Cadodecylbenzene sulphonate and isooctylphenylpoly (10 mol) glycolether in a ratio of 1:1 (subsequently called "mixture") and 0.2% of Coriagen Cr II over the course of 40 minutes. Then, 20% water at 30° C, 5% NaCl, 1.2% HCOOH 85%, 0.6% EROPIC DVP and 0.8% $H_2SO_4$ are added to the same bath and are left for 120 minutes. The pH value at the beginning is 3.8 and is adjusted to 3.0 to 3.3 after adding $H_2SO_4$. Then 1.5% of glutaraldehyde 25% is entered into the same bath over the course of 60 minutes, and after standing over night the pH is 3.0 to 3.3. Chromium tanning follows. 12.5% chromium-red liquor A, 33% bas., with a 10% $Cr_2O_3$ content are standardised to a basicity of 42%. After 30 minutes, 1% of the phenylsulphone described before this Example is added to the same bath, this being described hereinafter as sulphone, and 12.5% chromium-red liquor A, neutralised to 42% bas., is also added, this being mixed prior to its addition. The leathers are subsequently beaten for 180 minutes. Neutralisation takes place using a solution of: 20% water at 60° C, 1.5% calc. soda, 0.3% Na-formiate and 1% sulphone (cooling to 20° C) is known manner. When these have been completely added, (pH 4.2) beating takes place for 1–3 hours and the bath is tested for chromium removal. The work is completed as usual.

EXAMPLE 3

The procedure is the same as for Example 2 until reaching the pickel stage. To the pickel bath amounting to 44.8% are added 25% chromium-red liquor A (see Example 1) standardised to 42% bas. mixed with 3% of the sulphone over the course of 30 minutes at 30° C. This mixture is prepared at 60° C 24 hours before addition. Subsequently, it is beaten at 33° C for 180 minutes. Neutralisation takes place as usuaal with 20% water (0° C), 1.5% calc. soda and 0.3% Na-formiate at 20° C. Aftter these have been completely added (pH 4.2), it is beaten for 2 hours and the leather is left over night in the cask. The work is completed as usual. The leather is ready for boiling.

EXAMPLE 4

(Retanning of pig suede for clothing with buckskin using resin tanning matter).

(The percentages given relate to the folded weight). A leather of the above-mentioned kind which has been tanned according to Examples 2 or 3 with chromium is retanned as follows (resin plump tanning):

The skins which have been tanned with chromium are washed twice with 400% water at 60° C (duration 5 minutes). The resin plump tanning according to the invention follows. 50% water at 60° C and 2% sulphone are mixed with 4% of tergotan GS and are beaten for 20 minutes (pH 4). To the extended bath are added for the purpose of neutralisation 250% water at 60° C, 1% Na-formiate and 2% Na-bicarbonate in the normal manner. The pH is 6.9 after 40 minutes. This is washed twice with 400% water at 60° C (duration 5 minutes). Subsequently, this is fat-liquored over the course of 90 minutes with 40% water at 50° C, 2% sulphone, 1% tergolix A and 9% of a mixture of a non-ionic commercial emulsifier, 2% of a chlorinated hydrocarbon, 6% of sulphonated sperm oil, 3% of relcasyn filler F, and then 0.5% of katalix GS are added to the extended bath over the course of 15 minutes. The skins are beaten over night on the trestle, stretched, bonded dry and then buffed with paper 180.

EXAMPLE 5

(Retanning of pig suede and buckskin using chromium tanning matter)

(The percentages relate to folded weight).

The skins which have been chromium tanned as in the previous Examples are washed for 10 minutes with 400% water at 60° C and 0.5% of mixture. The bath is drained and rinsed again at 60° C with 400% water. It is retanned at a pH of 3.9 for 120 minutes in 35% water at 40° C with 10% of a mixture of 10% $Cr_2O_3$ standardised at 50% bas. and 5% of sulphone. The work is completed as in the previous Examples.

EXAMPLE 6

(Production of cow-hide suede and with synthetic tanning matter)

(The percentages again relate to the folded weight).

A cow-hide which has been chromium tanned according to the invention (similarly to Example 5) is washed for 10 minutes with 400% water at 60° C and 0.5% of the mixture of Example 2. The bath is drained and washed again with 400% water at 60° C over the course of 10 minutes. The combined chromium-vegetable retanning (over the course of 120 minutes at a pH of 3.8) takes place using 35% water at 40° C, 10% chromium-red liquor A (standardised at 50% bas.) and 2% tannigan OS Plv. (synthetic tanning matter). Work is completed as in the previous Examples.

EXAMPLE 7

(Zirconium tanning)

When retanning by the process described for Example 5 but with 6% of zirconium sulphate tanning matter (commercial) mixed with 5% sulphone, particularly light leathers of excellent quality are obtained for white preparations.

EXAMPLE 8

(Dyeing of pig buckskin for shoes)

After the usual milling and rinsing processes, a pig skin is pre-treated in the dye bath for 20 minutes with 600% water (40° C), 2% $NH_3$, 3% sulphone and with the addition of 2% cartan O. The first half of dyestuff addition is made in the same bath, this consisting of 4.5% derma brown 29, 0.5 % derma brown 1068, 1% derma brown 1294. The dyestuff is milled in for 90 minutes and is acidified as usual with formic acid.

An intermediate treatment takes place in the new bath consisting of 100% water at 40° C, 10% chromium liquor A, 50% bas. and 2% sulphone, before further dyeing takes place. After rinsing with 600% water at 60° C for 5 minutes, there is overdyeing with 600% water at 60° C, 1% ammonia 25%, 0.5 % sulphone and the second half of the above dyestuff mixture. After 60 minutes of milling, it is acidified as usual. A good, evenly dyed leather having deep shades is obtained.

EXAMPLE 9

(Dyeing pig-suede)

A good, evely through-dyed leather in pastel shades is obtained by proceeding as for Example 8 when dyeing pig-suede, but omitting the intermediate treatment with chromium sulphate and sulphone and adding the dyestuff mixture in one stage.

What is claimed is:

1. A tanning agent for leather, being the product of admixture of a zirconium or chromium salt and an aryl sulphone composition which composition is obtained by a. sulphonation with sulphuric acid and at a temperature of from 80° to 150° C, a component (i) comprising at least one aromatic phenolic compound containing from 6 to 20 carbon atoms and having at least one hydroxyl group bound to a phenyl ring, and a component (ii) comprising at least one aromatic, non-phenolic compound containing from 6 to 20 carbon atoms, from 1 to 30% of component (i) and from 99 to 70% of component (ii), based on the total weight of components (i) and (ii), being employed, and removing water of sulphonation produced, and b. condensing the resulting sulphonation product together with any unsulphonated components (i) and (ii), at a temperature of from 120° to 220° C, until the acid number of the mixture remains substantially constant.

2. A tanning agent according to claim 1, wherein said component (i) comprises one or more phenolic compounds of formula I,

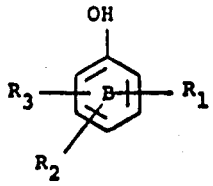

I in which either $R_1$, $R_2$ and $R_3$ are the same or different and each is hydrogen, hydroxy, halo, carboxy or a radical of formula II, $$A-[X]_n \qquad II$$

in which X is —O—, —S—, —SO—, —$SO_2$, alkylene of 1 to 4 carbon atoms or haloalkylene of 1 to 4 carbon atoms, $n$ is 0 or 1, and A is alkyl of 1 to 4 carbon atoms, haloalkyl of 1 to 4 carbon atoms, phenyl, phenyl substituted by halo, carboxy or hydroxy or diphenyl, or $R_1$, $R_2$ and $R_3$ together with ring B is naphthalene, anthracene, fluorene or dibenzofuran, provided that the commpounds contain from 6 to 20 carbon atoms, and said component (ii) comprises one or more compounds of formula III,

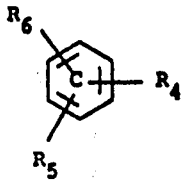

III in which $R_4$, $R_5$, $R_6$ and ring C have the same significance as $R_1$, $R_2$, $R_3$ and ring B, defined above, except that none may signify or contain hydroxy, and $R_4$, $R_5$ and $R_6$ together may further signify nethylnaphthalene, provided that the compounds contain from 6 to 20 carbon atoms.

3. A tanning agent according to claim 2, wherein component (i) is ortho-phenylphenol and component (ii) is diphenylether.

4. A tanning agent according to claim 1, wherein the weight ratio of component (ii) to component (i) is from 70 to 99:30 to 1.

5. A tanning agent according to claim 4, wherein said ratio is in the range of 80 to 97 : 20 to 3.

6. A tanning agent according to claim 5, wherein said ratio is 95 : 5.

7. A tanning agent according to claim 1, wherein the weight ratio of sulphone to chromium or zircomium salt lies between 1 : 100 and 1 : 1.

8. A tanning agent according to claim 7, wherein said weight ratio lies between 1 : 10 and 1 : 2.

9. A tanning agent according to claim 1, in the form of a 20 to 75% by weight aqueous solution.

10. A tanning agent according to claim 9, in the form of a 40 to 60% by weight aqueous solution.

11. A tanning agent according to claim 9, containing up to 5% by weight of formic acid.

12. A tanning agent according to claim 1, wherein the chromium or zirconium salt is the sulphate thereof.

13. A tanning process for leather comprising employing as tanning agent an agent according to claim 1.

14. A process according to claim 13, wherein the amount of tanning agent employed is such as to give a weight ratio of chromium or zirconium salt to the weight of the skin of from 5 to 12%.

15. A process according to claim 14, wherein said amount is such as to give a ratio of from 6 to 10%.

16. A process for the synthetic, vegetable, or chrome tanning of leather wherein there is applied to the leather an aryl sulphone composition obtained by a. sulphonation with sulphuric acid and at a temperature of from 80° to 150° C, a component (i) comprising at least one aromatic phenolic compound containing from 6 to 20 carbon atoms and having at least one hydroxyl group bound to a phenyl ring, and a component (ii) comprising aat leas one aromatic, non-phenolic compound containing from 6 to 20 carbon atoms, from 1 to 30% of component (i) and from 99 to 70% of component (ii), based on the total weight of components (i) and (ii), being employed, and removing water of sulphonation produced, and b. condensing the resulting sulphonation product together with any unsulphonated components (i) and (ii), at a temperature of from 120° to 220° C, until the acid number of the mixture remains substantially constant, in an amount of from 0.5 to 10% based on the folded dry weight of the skin.

17. A fat-liquoring process for leather wherein there is applied to the leather, to facilitate fat distribution, an aryl sulphone composition obtained by a. sulphonation with sulphuric acid and at a temperature of from 80° to 150° C, a component (i) comprising at least one aromatic phenolic compound containing from 6 to 20 carbon atoms and having at least one hydroxyl group bound to a phenyl ring, and a component (ii) comprising at least one aromatic, non-phenolic compound containing from 6 to 20 carbon atoms, from 1 to 30% of component (i) and from 99 to 77% of component (ii), bases on the total weight of components (i) and (ii), being employed, and removing water of sulphonation produced, and b. condensing the resulting sulphonation product together with any unsulphonated components (i) and (ii), at a temperature of from 120° to 220° C, until the acid number of the mixture remains substantially constant, in an amount of from 0.3 to 3% bases on the folded dry weight of the skin.

* * * * *